US005944040A

United States Patent [19]

Jang

[11] Patent Number: 5,944,040

[45] Date of Patent: Aug. 31, 1999

[54] COLLAPSIBLE TENT FRAME

[76] Inventor: Jung-Woo Jang, 53-28 Gamsam Dong Dalseo-Ku, Daegu, Rep. of Korea

[21] Appl. No.: 09/082,482

[22] Filed: May 21, 1998

[30] Foreign Application Priority Data

May 23, 1997 [KR] Rep. of Korea ..... 97-11752

[51] Int. Cl.[6] ..... E04H 15/26

[52] U.S. Cl. ..... 135/126; 135/128; 135/130; 135/131

[58] Field of Search ..... 52/79.5; 135/126, 135/128, 131, 130, 97

[56] References Cited

U.S. PATENT DOCUMENTS

| | | | |
|---|---|---|---|
| 1,666,757 | 4/1928 | Sntder | 135/97 |
| 4,641,676 | 2/1987 | Lynch | 135/110 |
| 4,779,635 | 10/1988 | Lynch | 135/97 |
| 4,947,884 | 8/1990 | Lynch | 135/97 |
| 5,275,188 | 1/1994 | Tsai | 135/97 |
| 5,421,356 | 6/1995 | Lynch | 135/145 |
| 5,634,483 | 6/1997 | Gwin | 135/131 |
| 5,701,923 | 12/1997 | Losi, Jr. et al. | 135/131 |
| 5,794,640 | 8/1998 | Jang | 135/131 |

*Primary Examiner*—Carl D. Friedman
*Assistant Examiner*—Dennis L. Dorsey
*Attorney, Agent, or Firm*—Griffin, Butler, Whisenhunt & Szipl, LLP

[57] ABSTRACT

A collapsible tent frame is disclosed. The tent frame has a center pole used for stretching and sustaining a tent's roof when pitching a tent. A plurality of side poles are coupled to each other through a plurality of scissor-type ribs, with upper ends of the ribs being hinged to connectors provided at top ends of the side poles and lower ends of the ribs being hinged to sliders movably fitted over the side poles. The center pole is coupled to the connectors of the side poles through a plurality of center pole ribs. The above center pole ribs individually consist of two rib members, which are coupled to each other through a hinge joint. Each of the center pole ribs is also hinged to the slider of an associated side pole through a support link, thus being collapsible at the hinge joint in accordance with a sliding motion of the slider along the side pole.

3 Claims, 4 Drawing Sheets

COLLAPSIBLE TENT FRAME

BACKGROUND OF THE INVENTION

1. Field of the Invention

The present invention relates, in general, to collapsible tent frames capable of making, pitching or striking a tent easily and quickly when necessary and, more particularly, to a collapsible tent frame suitable for giving an enlarged and heightened interior space to users when pitching a tent.

2. Description of the Prior Art

As well known to those skilled in the art, a tent is a collapsible shelter of canvas or other material stretched over and sustained by a frame and is used for camping outdoors or as a temporary structure. It is preferable for such a tent to be easily and quickly pitched or struck when necessary, so a frame for such tents is preferably designed for being collapsible. Examples of typical collapsible tent frames are referred to U.S. Pat. Nos. 4,641,676 (issued on Feb. 10, 1987), 4,779,635 (issued on Oct. 25, 1988), 4,947,884 (issued on Sep. 14, 1990), 5,275,188 (issued on Jan. 4, 1994) and 5,421,356 (issued on Jan. 6, 1995).

The above U.S. patents individually disclose a collapsible tent frame which comprises a plurality of side pole ribs 2, with each pair of ribs 2 being coupled to each other at the center of them into a scissor assembly as shown in FIG. 1. The scissor assemblies of the side pole ribs 2 are also coupled to each other at joints 2a and are connected to four side poles 1 at their outside ends.

In such a case, the outside upper end of each scissor assembly of the ribs 2 is hinged to the top end of a side pole 1, while the outside lower end of each scissor assembly is hinged to a slider 7 movably fitted over the side pole 1. Therefore, when a user moves the four side poles 1 to the center of the tent frame, the sliders 7 move down on the side poles 1 respectively, thus folding the scissor assemblies of the ribs 2 at the joints 2*a* and collapsing the tent frame.

The above tent frame also comprises a plurality of center pole ribs 3, with each pair of ribs 3 being coupled to each other at the center of them into a scissor assembly. Each scissor assembly of the above ribs 3 is hinged to the joints 2*a* of the side pole ribs 2 at the outside ends and are hinged to a center pole 6 at the inside ends. In such a case, the inside lower end of each scissor assembly of the ribs 3 is hinged to a connector 4 provided on the lower end of the center pole 6, while the inside upper end of each scissor assembly is hinged to a slide guider 5 into which the center pole 6 is movably fitted. Therefore, when the four side poles 1 are moved to the center of the tent frame, the center pole 6 moves down in the slide guider 5, thus folding the scissor assemblies of the center pole ribs 3 and collapsing the tent frame.

However, the above collapsible tent frame has the following problem. That is, in the above tent frame, the center pole ribs 3 are coupled to the joints 2*a* of the side pole ribs 2. Therefore, when pitching a tent, the center pole ribs 3 are positioned across the upper portion of the interior space as shown in FIG. 2, thus limiting the height of the interior space.

It is thus necessary for a user to be careful lest one bumps one's head against the center pole ribs 3 or the connector 4 while going out of, coming into or standing in the tent. Therefore, the above tent frame is inconvenient to users.

In addition, the center pole 6 comprises the connector 4 and the slide guider 5, thus having a complex construction and increasing the production cost of the tent frame. Another problem of the above collapsible tent frame resides in that it is too heavy for a user to easily handle or move the frame.

SUMMARY OF THE INVENTION

Accordingly, the present invention has been made keeping in mind the above problems occurring in the prior art, and an object of the present invention is to provide a collapsible tent frame, of which the center pole is coupled to the side poles, thus giving an enlarged and heightened interior space to users when pitching a tent and allowing a user to easily handle the frame when pitching or striking the tent.

In order to accomplish the above object, the present invention provides a collapsible tent frame, comprising: a center pole used for stretching and sustaining a tent's roof when pitching a tent; a plurality of side poles coupled to each other through a plurality of scissor-type ribs, with upper ends of the ribs being hinged to connectors provided at top ends of the side poles and lower ends of the ribs being hinged to sliders movably fitted over the side poles; and a plurality of center pole ribs coupling the center pole to the connectors of the side poles, the center pole ribs individually comprising two rib members coupled to each other through a hinge joint and being hinged to the slider of an associated side pole through a support link, thus being collapsible at the hinge joint in accordance with a sliding motion of the slider along the side pole.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
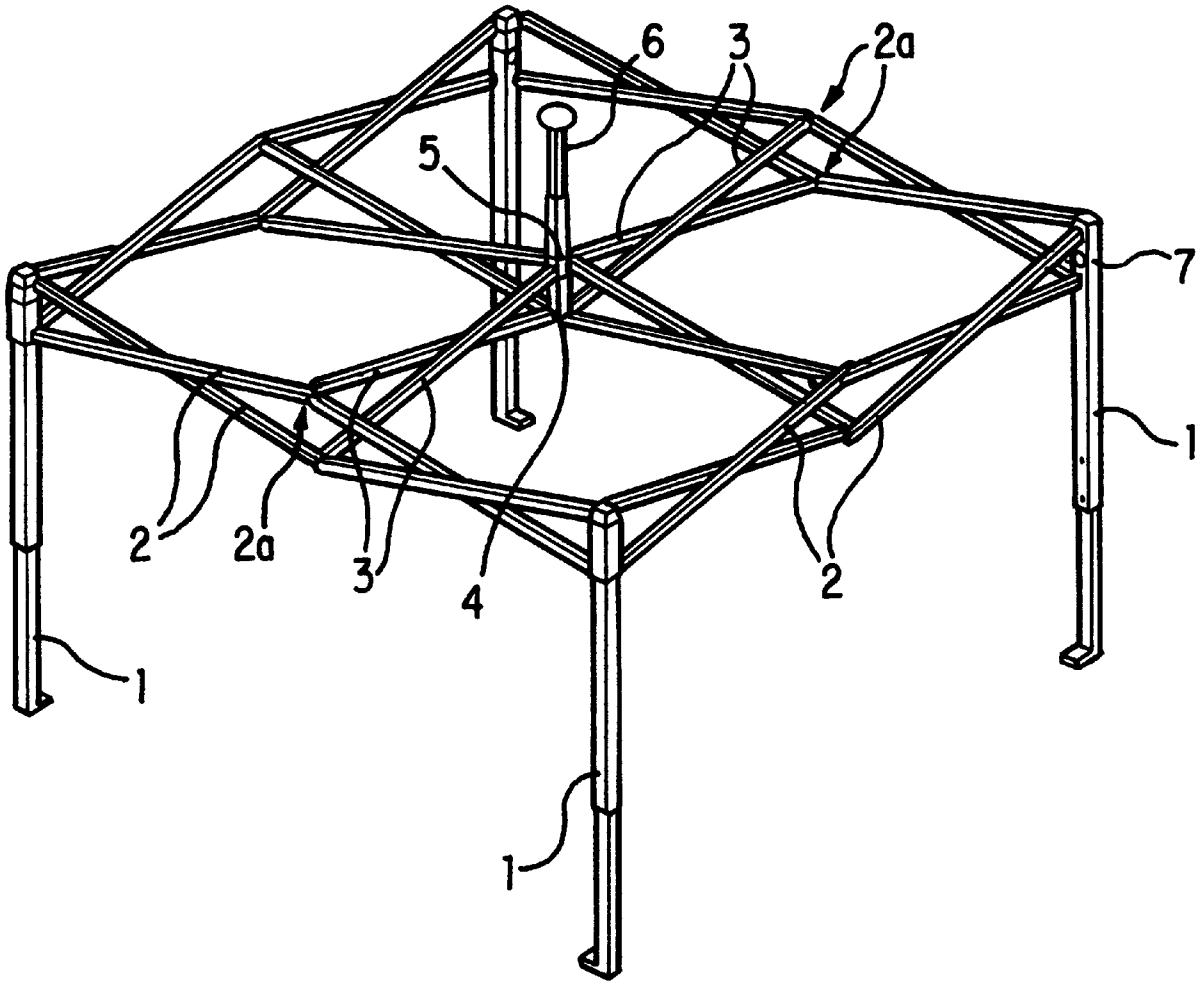
FIG.1 PRIOR ART
FIG. 1 is a perspective view showing the construction of a typical collapsible tent frame.
Figure 2:
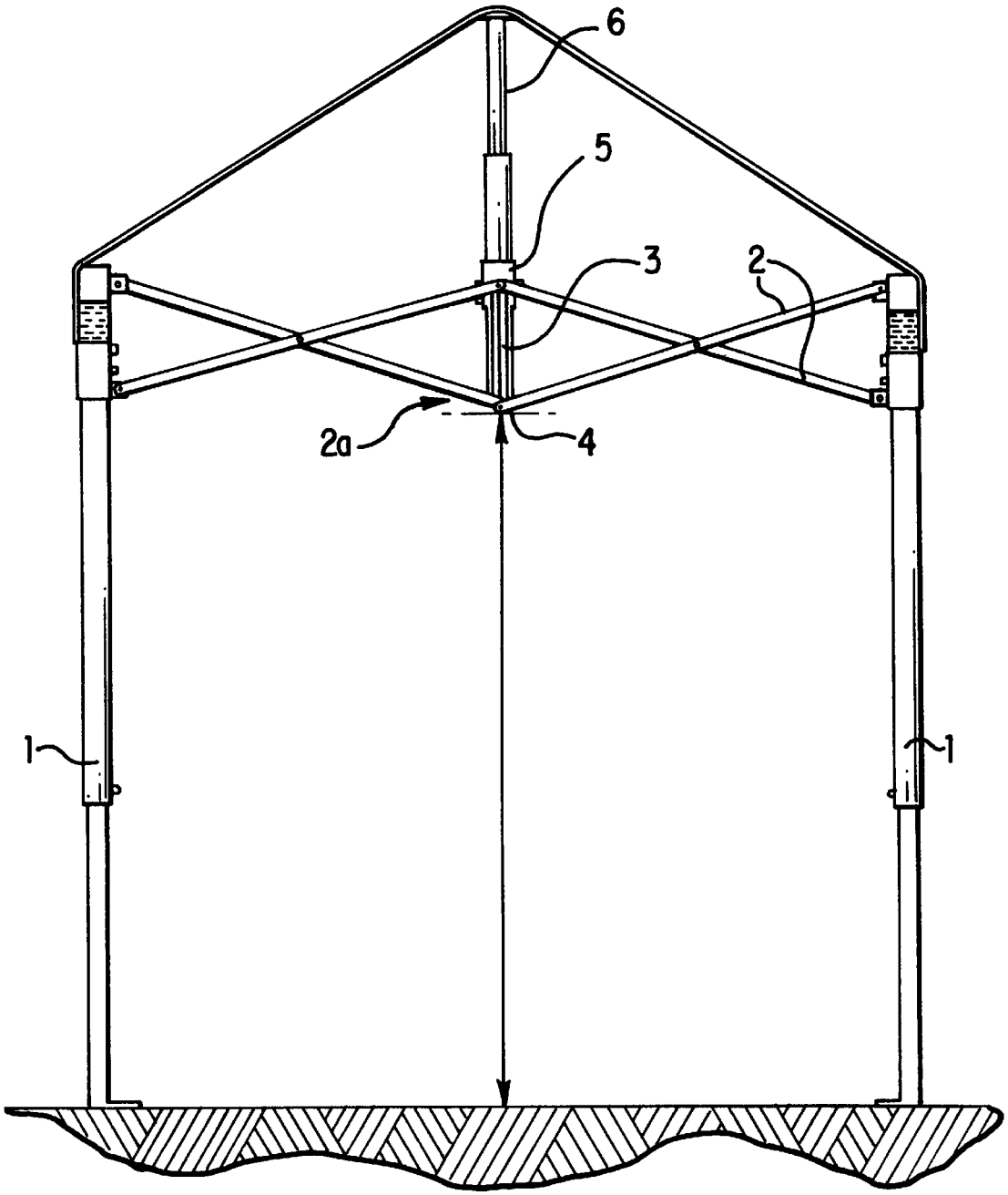
FIG. 2 PRIOR ART
FIG. 2 is a sectional view of a tent with the typical collapsible tent frame when the tent is completely pitched.
Figure 3:
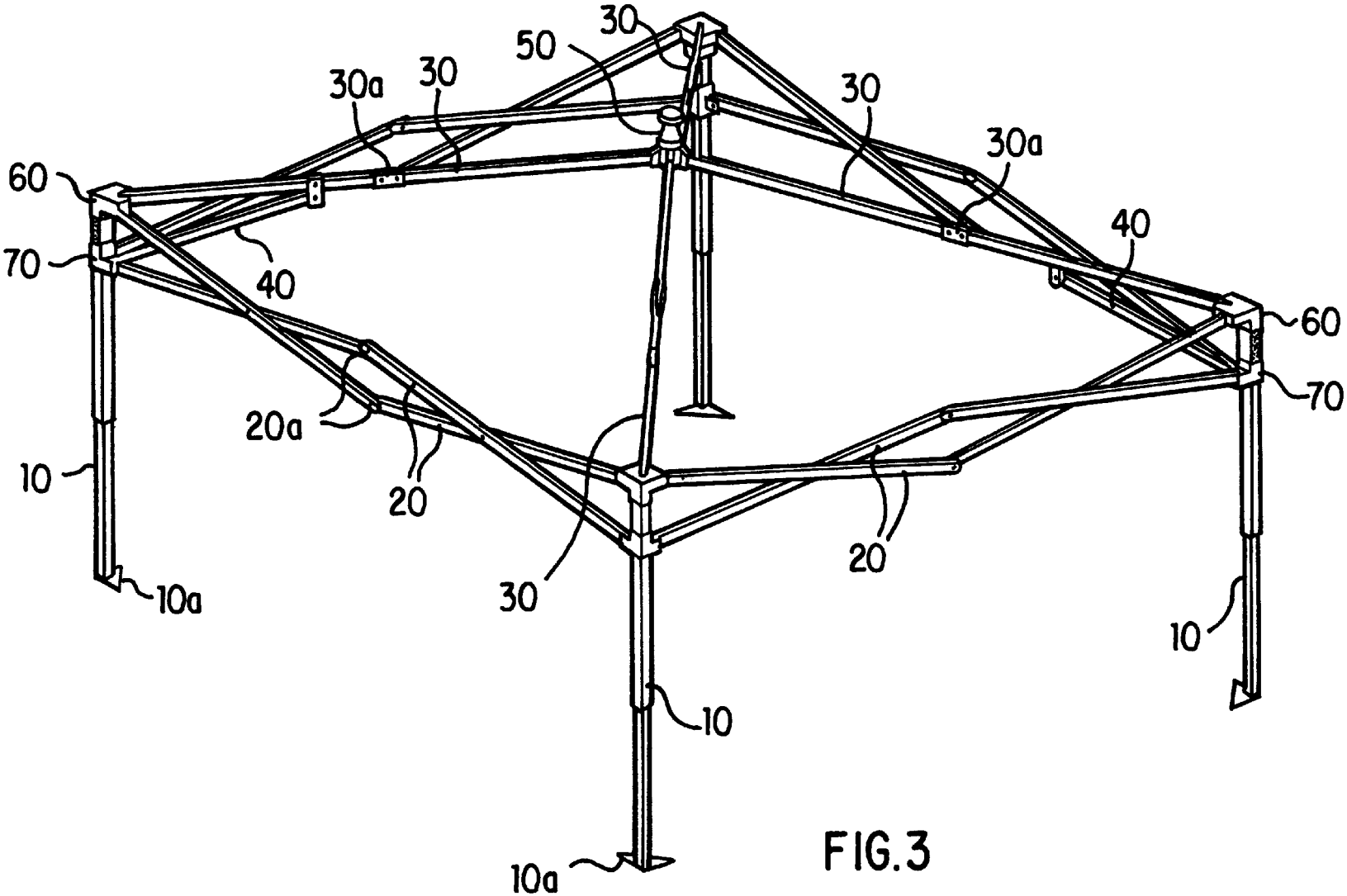
FIG. 3 is a perspective view showing the construction of a collapsible tent frame in accordance with the preferred embodiment of the present invention.
Figure 4:
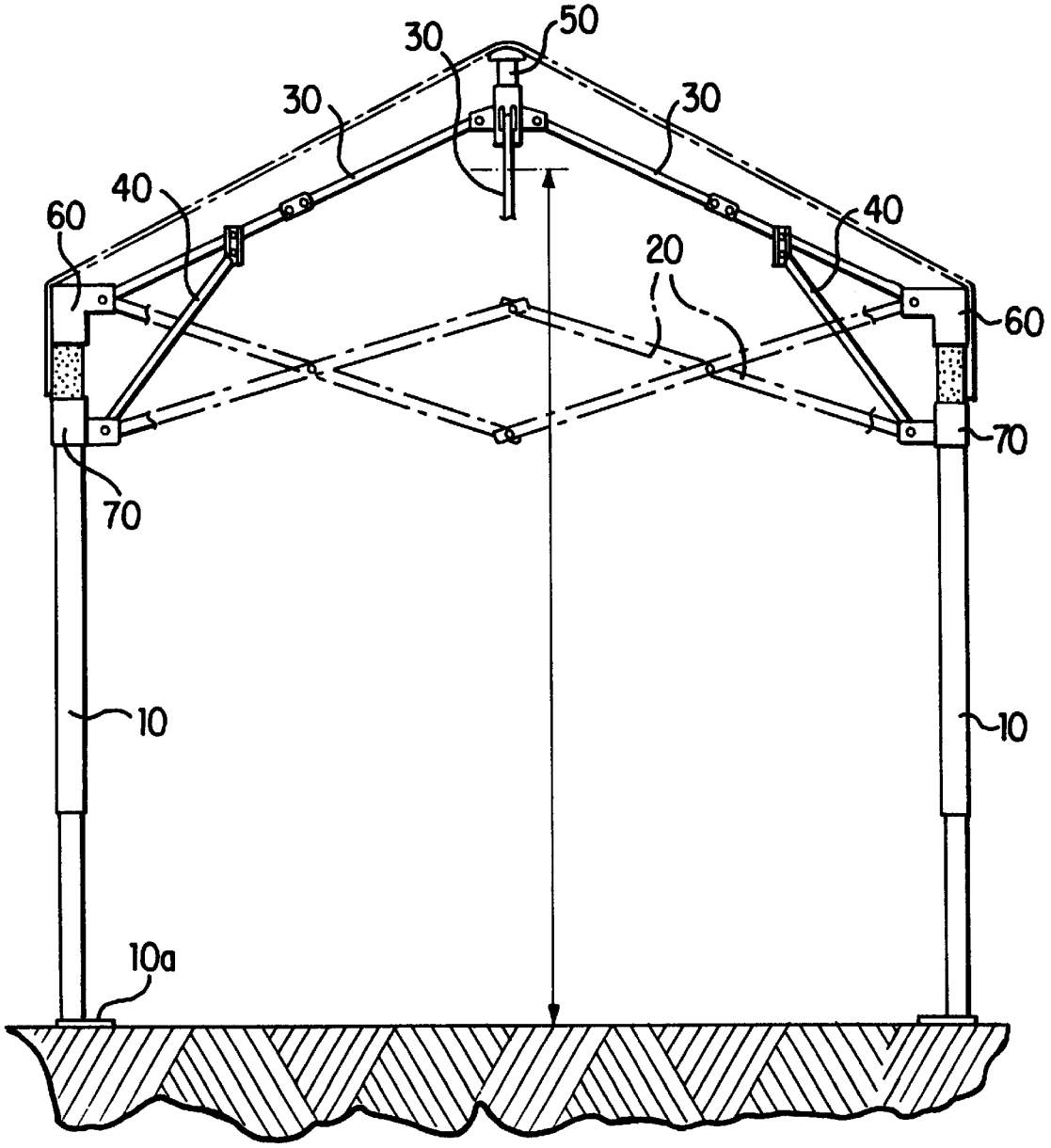
FIG. 4 is a sectional view of a tent with the collapsible tent frame of this invention when the tent is completely pitched.

FIG. 3 is a perspective view showing the construction of a collapsible tent frame in accordance with the preferred embodiment of this invention. FIG. 4 is a sectional view of a tent with the collapsible tent frame of this invention when the tent is completely pitched.

As shown in the drawings, the tent frame of this invention comprises a plurality of side pole connection beams 20, with each pair of ribs 20 being coupled to each other at the center of them into a scissor assembly. The scissor assemblies of the side pole ribs 20 are also coupled to each other at joints 20*a* and are connected to four side poles 10 at their outside ends. In such a case, the outside upper end of each scissor assembly of the ribs 20 is hinged to a connector 60 provided at the top end of each side pole 10, while the outside lower end of each scissor assembly is hinged to a slider 70 movably fitted over the side pole 10.

The four side poles 10 are individually coupled to a center pole 50, having a simple construction, through a center pole rib 30. The center pole ribs 30 individually comprise two rib members, which have the same construction and are coupled to each other through a hinge joint 30*a*. The above center pole ribs 30 are also coupled to the sliders 70 through support links 40 at the outside rib members, respectively. Therefore, the collapsible tent frame of this invention is easily and quickly stretchable or collapsible, thus allowing a user to easily and quickly pitch or strike a tent.

Each of the side poles 10 is provided with a claw 10*a* at the lower end, thus being stably held on the ground. The sliders 70 are designed for being slidable along the side poles 10 in opposite directions.

The operational effect of the above collapsible tent frame will be described hereinbelow.

The above tent frame is integrated with a canvas or other material, thus forming a tent.

When it is necessary to pitch the tent, the four side poles 10 are pushed outwardly at the same time, thus stretching the tent frame. When the side poles 10 are pushed outwardly as described above, the sliders 70 move upward along the side poles 10 while stretching the two types of ribs 20 and 30. Therefore, the tent frame stretches and sustains the canvas or other material and pitches the tent.

In such a case, the center pole ribs 30 are fully stretched by the support links 40, which connect the ribs 30 to the sliders 70, with the hinge joints 30*a* of the ribs 30 being moved upwardly. Therefore, the center pole 50 moves upwardly and sustains the center of the roof while stretching the roof as shown in FIG. 4.

When the tent is pitched with the frame being fully stretched as described above, the center pole 50 moves upwardly along with the center pole ribs 30, so the tent frame of this invention heightens the interior space of the tent in comparison with a typical collapsible tent frame. Therefore, the tent frame of this invention allows users to freely go out of, come into or stand in the tent without being concerned about bumping one's head against the center pole ribs 30 or the center pole 50.

When it is necessary for a user to strike the tent, the user moves the four side poles 10 to the center of the tent frame, thus allowing the sliders 70 to move down on the side poles 10 while folding the scissor assemblies of the ribs 20 at the joints 20*a*. In such a case, the support links 40, connecting the center pole ribs 30 to the sliders 70, pull the ribs 30 downwardly, thus folding the ribs 30 at the joints 30*a* and moving the center pole 50 downwardly. The tent is thus completely struck with the tent frame being fully collapsed. Such a collapsed frame effectively reduces the volume and weight of the tent and allows a user to easily and conveniently carry the tent.

As described above, the present invention provides a collapsible tent frame, of which the center pole has a simple construction and is directly coupled to the side poles through a plurality of center pole ribs. The above center pole ribs individually comprise two rib members, which have the same construction and are coupled to each other through a hinge joint. The above center pole ribs are also coupled to the sliders of the side poles through a plurality of support links at the outside rib members, respectively. Therefore, the collapsible tent frame of this invention has a simple construction capable of effectively reducing the production cost, volume and weight of a tent. When the frame is stretched so as to pitch a tent, the center pole is fully moved upwardly along with the center pole ribs. The tent frame thus heightens the interior space of the tent in comparison with a typical collapsible tent frame and allows users to freely go out of, come into or stand in the tent without being concerned about bumping one's head against the center pole ribs or the center pole. The collapsible tent frame of this invention is thus convenient to users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A collapsible tent frame, comprising:

a center pole constructed for stretching and sustaining a tent's roof when a tent is pitched with the tent frame;

a plurality of side poles coupled to each other through a plurality of scissor-type ribs, with upper ends of said ribs being hinged to connectors provided at top ends of said side poles and lower ends of said ribs being hinged to sliders movably fitted over said side poles; and plurality of center pole ribs coupling said center pole to said connectors of the side poles, said center pole ribs individually comprising two rib members coupled to each other through a hinge joint and being hinged to the slider of an associated side pole through a support link, thus being collapsible at the hinge joint in accordance with a sliding motion of said slider along the side pole.

2. A collapsible tent frame according to claim 1, wherein said rib members of the center pole ribs have a substantially equal length.

3. A collapsible tent frame according to claim 2, further comprising a claw member disposed at a lower end of each side pole.

* * * * *